United States Patent [19]

Timperi et al.

[11] Patent Number: 5,058,615

[45] Date of Patent: Oct. 22, 1991

[54] METHOD AND APPARATUS FOR PUMPING HIGH CONSISTENCY PULP

[75] Inventors: Jukka Timperi; Reijo Vesala, both of Kotka; Vesa Vikman, Kymi, all of Finland

[73] Assignee: A. Ahlstrom Corporation, Noormarkku, Finland

[21] Appl. No.: 214,328

[22] Filed: Jul. 1, 1988

[30] Foreign Application Priority Data

Jul. 2, 1987 [FI] Finland ..... 872918

[51] Int. Cl.[5] ..... E03B 3/18

[52] U.S. Cl. ..... 137/1; 137/550; 137/565; 162/380; 415/168.1

[58] Field of Search ..... 137/1, 544, 550, 565; 415/168, 121 A; 162/380; 210/787, 512.1

[56] References Cited

U.S. PATENT DOCUMENTS

| | | | |
|---|---|---|---|
| Re. 29,472 | 11/1977 | Kaiser | 162/380 |
| 2,306,298 | 12/1942 | Curtis | 415/168 |
| 2,996,187 | 8/1961 | Payne | 210/787 |
| 3,823,063 | 7/1974 | Callahon et al. | 162/380 |
| 4,126,513 | 11/1978 | Justus et al. | 162/380 |
| 4,316,768 | 2/1982 | Goddard | 162/380 |
| 4,781,529 | 11/1988 | Rose | 415/168 |

FOREIGN PATENT DOCUMENTS

| | | | |
|---|---|---|---|
| 964287 | 5/1957 | Fed. Rep. of Germany | 162/380 |

*Primary Examiner*—A. Michael Chambers

*Attorney, Agent, or Firm*—Cohen, Pontani & Lieberman

[57] ABSTRACT

A method and apparatus for pumping a liquid-fiber suspension, and specifically for pumping high consistency fiber suspensions in the pump and paper industry. The method of pumping a liquid-fiber suspension includes the moving of the suspension into a pump, separating a portion of the liquid part of the suspension from the liquid-fiber suspension during the pumping operation and directing the separated liquid to the suspension at a point somewhere between a situs in advance of the pump inlet and the pump outlet. This method is enabled by an apparatus, in which at least part of the surfaces of the pump (1) is provided with filter surfaces (6, 7, 8, 9, 10), through which the liquid separated from the suspension is returned either into the pump, directly in front of the suction opening (11) of the pump (1) or to some other suitable place in the vessel containing the suspension.

29 Claims, 4 Drawing Sheets

METHOD AND APPARATUS FOR PUMPING HIGH CONSISTENCY PULP

FIELD OF THE INVENTION

The present invention relates to a method and apparatus for pumping liquid-fiber suspensions such as pulp. The method and apparatus in accordance with the invention are particularly suited for treating high consistency fiber suspensions in the pulp and paper industry.

BACKGROUND OF THE INVENTION

There are several known methods and apparatuses for pumping high consistency liquid-fiber suspensions such as pulp. Previously only displacement pumps, such as screw pumps or the like, were used to pump high consistency pulp. Nowadays the tendency has been to replace the displacement pumps because of their deficiencies and other inherent drawbacks. The intention has been to develop a centrifugal pump, normally used for pumping water and the like, for pumping high consistency pulp. One of the first problems encountered when attempting to pump liquid-fiber suspensions having a consistency of more than 8% is that the suspension does not independently flow to the impeller of the pump in the suction opening. It has been suggested as a solution to this problem that a special screw feeder be used to feed the suspension to the suction opening of the pump or that a so-called inducer be arranged in the suction opening of the pump to convey the suspension in the suction opening towards the pump impeller. However, with this type of pump it has not been possible in commercial practice to pump fiber suspensions having a consistency which approaches 15%. A third example of possible solutions is a so-called fluidizing centrifugal pump used for pumping high consistency pulp, in which pump the fluidizing rotor extends to the suction opening of the pump or in some cases through it as far as into the mass tower. By using this type of fluidizing rotor it has been possible to reach the above-mentioned consistency of 15%, which does not, however, satisfy all requirements for pulp conveyancing in the pulp and paper industry.

Another possibility is, of course, the dilution of the pulp prior to the pump and the re-thickening of the pulp subsequent to the pump, as has been done with different pulp treating devices according to prior art techniques. This known technique, however, also has disadvantages such as the increased need of technical auxiliary devices, because both feeding and mixing devices are needed in the pulp vessel prior to the pump and thickening devices are needed subsequent to the pump for bringing the pulp back to its original consistency. A further disadvantage resides in the increased consumption of energy, which is required for the thickening of the pumped pulp.

SUMMARY OF THE INVENTION

The method and apparatus according to the present invention permit the elimination or minimization of known deficiencies and problems generally encountered during the pumping of liquid-fiber suspensions of medium and high consistency and particularly high consistency pulp and thus enable the easy pumping of high consistency pulp having a consistency of more than 15% without the need of a separate diluting apparatus and thickeners. The present invention is, however, also applicable to the pumping of pulp other than high consistency pulp. According to the invention, the liquid part from the liquid-fiber suspension is separated through separating means such as filter surfaces, screens, perforated surfaces or the like from the suspension being pumped. The separated liquid is used for the dilution of the liquid-fiber suspension entering the pump and/or to prevent clogging of the pump.

Thus, the present invention provides a method of pumping a liquid-fiber suspension with a pump having a housing with an inlet and outlet comprising the steps of moving said suspension into said pump; separating a portion of the liquid part of said suspension from said suspension by the pumping action; and directing said separated liquid to said suspension at a point somewhere between a situs in advance of said pump inlet and said pump outlet.

One object of the method of the invention is to withdraw liquid during the pumping process from a liquid-fiber suspension such as pulp being pumped, and thereafter feed the liquid to either the pumping zone or upstream of the pump for diluting the pulp to be pumped. The term pumping zone includes not only the zone between the pump inlet and the pump outlet but also the range of suction created in the vicinity of the pump inlet due to the pumping action of the pump; upstream of the pump has reference to either a conduit for the suspension leading to the pump or a vessel containing the liquid-fiber suspension such as a mass tower, drop leg or the like.

The apparatus according to the invention is characterized in that separating means such as one or more filter surfaces, screens or the like are arranged to communicate with the pumping apparatus so that liquid is discharged from the pulp being pumped. Preferably, conduit means is provided to return the discharged liquid to the pump in a region and/or manner so as to improve the pumping operation.

These and other objects of the method and apparatus in accordance with the invention will become more apparent after referring to the following detailed description.

BRIEF DESCRIPTION OF THE DRAWINGS

The invention is described in detail, by way of example, with reference to the accompanying drawings, in which.

DESCRIPTION OF THE PREFERRED EMBODIMENTS

Figure 1:
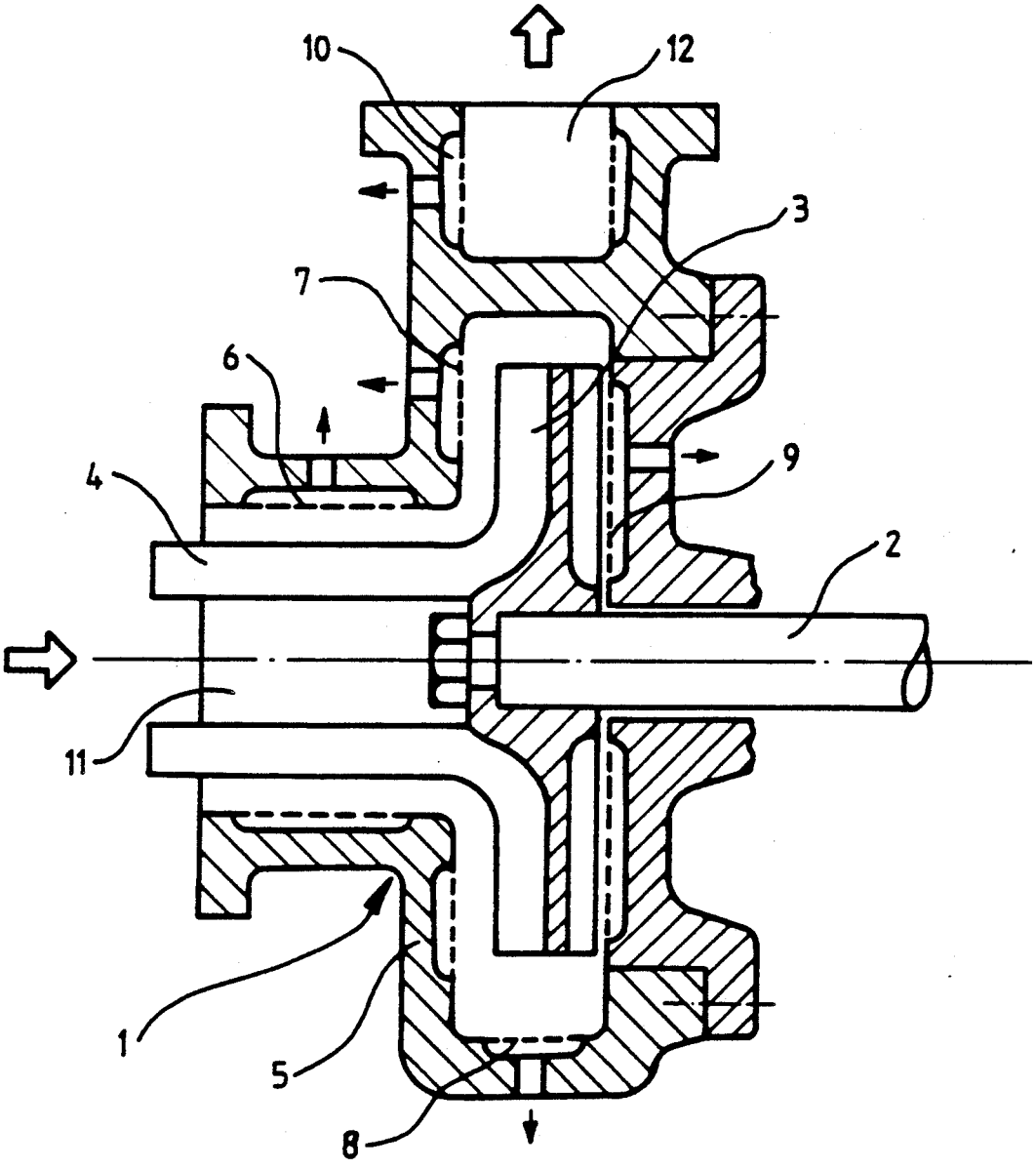
FIG. 1 is a schematic cross-sectional view illustrating an apparatus according to one preferred embodiment of the invention.

An apparatus in accordance with the invention shown in FIG. 1 comprises a pump, such as a centrifugal pump 1 conventionally including a shaft 2 and an impeller 3. It is possible to arrange a fluidizing rotor 4 or some other apparatus such as a screw feeder or the like in communication with the impeller 3 for feeding pulp to the impeller. According to FIG. 1 filter surfaces 6, 7, 8, 9 and 10 are arranged in the housing 5 of the pump 1, which surfaces may be located in shown fashion in the housing 5. Accordingly, filter surface 6 is located at the periphery of suction opening 11 of the pump either as a uniform cylinder or as separate surfaces. Likewise, filter surface 7, located in the pump housing wall opposite the front side of the impeller 3, may either be of annular shape or be formed of separate surfaces. Furthermore, the filter surface 8 located at the outer periphery of the pump housing opposite the top side of the impeller blades is similar to the previous surfaces, as well as filter surface 9 which is at least partly located behind the impeller on the rear wall of the pump housing and filter surface 10 which is arranged in communication with an outlet opening 12 of the pump housing.

The filter surfaces used as separating means may be made of metal plates which have been perforated by punching, boring or slotting and bent to a form needed. Other stiff materials may also be utilized such as, for example, plastics, glass fibre plates, etc. Preferably a porous plate or the like may be used having very small pores wherein the fibers cannot fit. The size of the openings is such that the diameter of the bores or the width of the slots is less than about 0.5 mm, preferably about 0.2 mm or less. When the size is about 0.5 mm the fibers may form a thin fiber network on the filter surface preventing the fiber flow from entering and passing through the openings. When the size of the openings is approximately 0.2 mm the fibers that move rapidly in a direction substantially perpendicular to the axis of the perforations are unable to turn sharply and to enter into the openings. Accordingly, the nominal diameter of the fibers, is preferably greater than the diameter or the width of the openings.

A chamber is provided behind each filter surface 6, 7, 8, 9 and 10, for recovering the liquid filtered through the respective filter surfaces and from which chambers the liquid can be transferred to another destination by means of openings or channels identified by the respective arrows. Pump 1 can be mounted at the flange surrounding the suction opening either to a mass tower, a drop leg, a suction pipe or the like.

Figure 2:
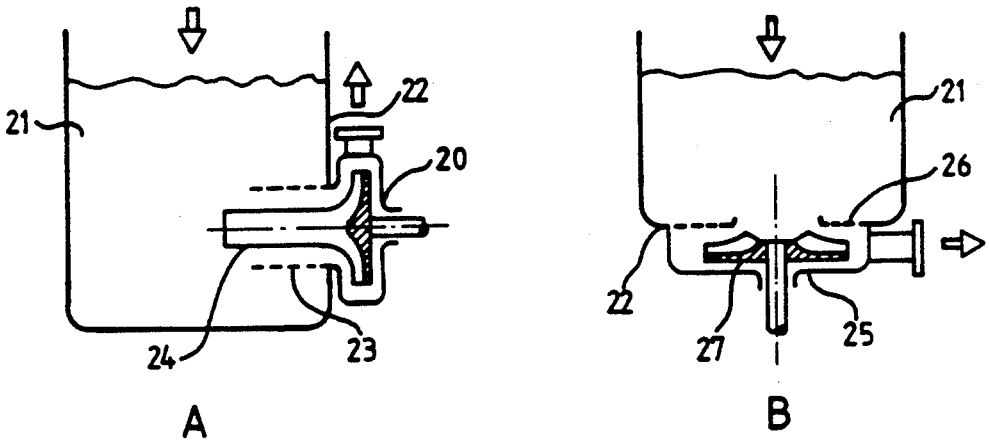
FIGS. 2A and 2B are schematic illustrations of an apparatus according to other preferred embodiments of the invention.

FIGS. 2A and 2B show an alternative embodiment of the apparatus according to the invention, which includes a centrifugal pump 20 mounted directly on a wall 22 of a mass tower 21 in such a way that no actual suction duct is needed. In this case (FIG. 2A) a pipe formed from filter surfaces 23 is arranged inside a mass tower 21, within which pipe an apparatus, such as a fluidizing rotor 24 facilitating the pulp feed is advantageously located. In this case the liquid filtered through the filter surface flows directly to mass tower 21 and dilutes the pulp outside the pipe or filter surface 23, thus causing the pulp to more easily flow to pipe 23. According to FIG. 2A the fluidizing rotor 24 may extend into the pulp beyond the limit of pipe 23 and thus facilitate the flow of pulp to pipe 23. In the modified embodiment of FIG. 2B there is arranged, for example, a front wall 26 of the housing of conventional centrifugal pump 25 to operate as a filter surface, whereby the impeller 27 causes the liquid to flow through filter surface 26 directly to the pulp to be pumped.

The pulp flowing to a mass tower, to a drop leg, to a suction pipe or the like may thus be diluted by the dilution liquid exiting from the filter surfaces, whereby the consistency of the liquid-fiber suspension flowing to the pump through pipe 23 or the suction opening of the pump is lower than the average consistency of the pulp within any of the above-mentioned spaces, which in turn, is lower than the consistency of the pumped pulp. The consistency of the pulp exiting the pump may correspond approximately to the consistency of the pulp fed into the mass tower. It is, of course, possible that the pump according to this embodiment includes one or more filter surfaces, by means of which the consistency of pulp is also raised in the pump or restored to its original value.

Figure 3:
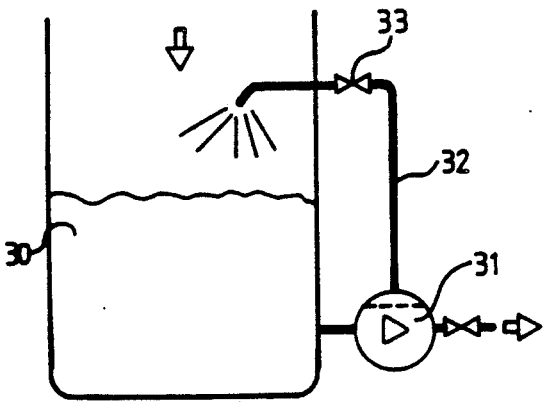
FIG. 3 shows an advantageous application according to the invention.

FIG. 3 shows another advantageous application in accordance with the invention, comprising a mass tower, drop leg or the like 30 with pump equipment 31 connected thereto. The pump equipment 31 may comprise pumps according to FIGS. 1 and/or 2, whereby the liquid chambers behind the filter surfaces 6–10 are connected to a pipe 32 leading back to the mass tower 30. A valve 33 provided in pipe 32 is used to control the amount of dilution liquid. It is, of course, possible to provide a separate pump for pumping the liquid gathered in the channels behind the filter surfaces to the mass tower.

Figure 4:
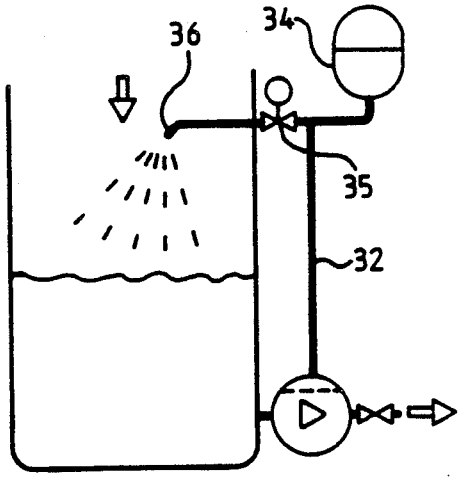
FIG. 4 shows a second advantageous application according to the invention.
Figure 5:
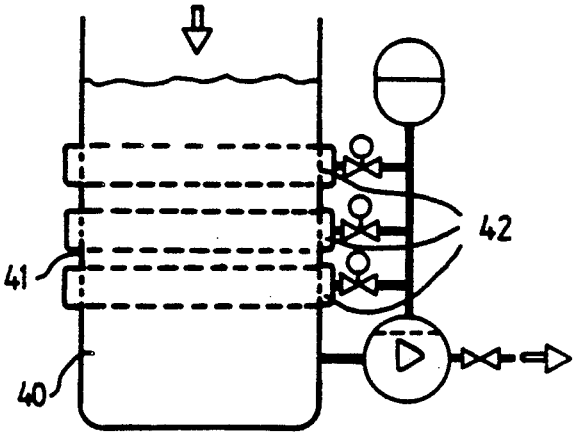
FIG. 5 shows a third advantageous application according to the invention.

FIG. 4 illustrates a situation similar to that of FIG. 3 except that a pressure accumulator installation 34 with valves 35 is provided in the return pipe 32 for the dilution liquid, which valves provide a pulsating feed to the dilution liquid fed to the mass tower. This method may be utilized in the embodiment of FIG. 5, e.g. feeding dilution liquid through nozzles 42 to the boundary surface 41 between the liquid-fiber suspension and the tower 40 or between the suspension and a suction pipe or other fiber suspensions containing vessel, whereby the liquid pulses reduce the friction therebetween and further facilitate the intensity of dilution. Instead of separate nozzles 42 a header or other continuous half-pipe may be provided at one or more levels around the mass tower, suction pipe or drop leg for feeding dilution liquid to the liquid-fiber suspension. Thus, the consistency of the surface layer of the pulp is lowered and hence the suspension flows more easily, for example, along the wall of a mass tower. The dilution liquid may also be fed, if desired, onto the fiber suspension in the mass tower as a pulsating flow via one or more nozzles 36, as shown in FIG. 4. It also is possible to feed the dilution liquid directly to the bottom of the mass tower as a pulsating or even, continuous flow, whereby the consistency of the pulp in the bottom part of the mass tower will be reduced and the pulp will flow more easily to the pump If dilution liquid is fed as a pulsating flow to the bottom of the mass tower, a slight fluidized-bed like effect may occur, which further facilitates the flow of the pulp to the suction opening of the pump.

Figure 6:
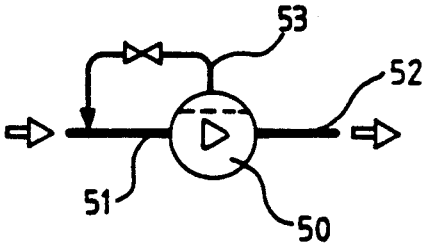
FIG. 6 shows a fourth advantageous application according to the invention.

Similarly, dilution liquid can be fed also in the embodiment of FIG. 6, in which pump 50 is arranged in the pipe installation with suction and discharge pipe 51 and 52. In this case dilution liquid is passed through the filter surfaces shown in FIG. 1 and returned via pipe 5 back to the pulp in suction pipe 51. In this embodiment, pulse feed shown in FIGS. 4 and 5 can also be advantageously applied and thus reduce the friction between pulp and suction pipe 51.

Figure 7:
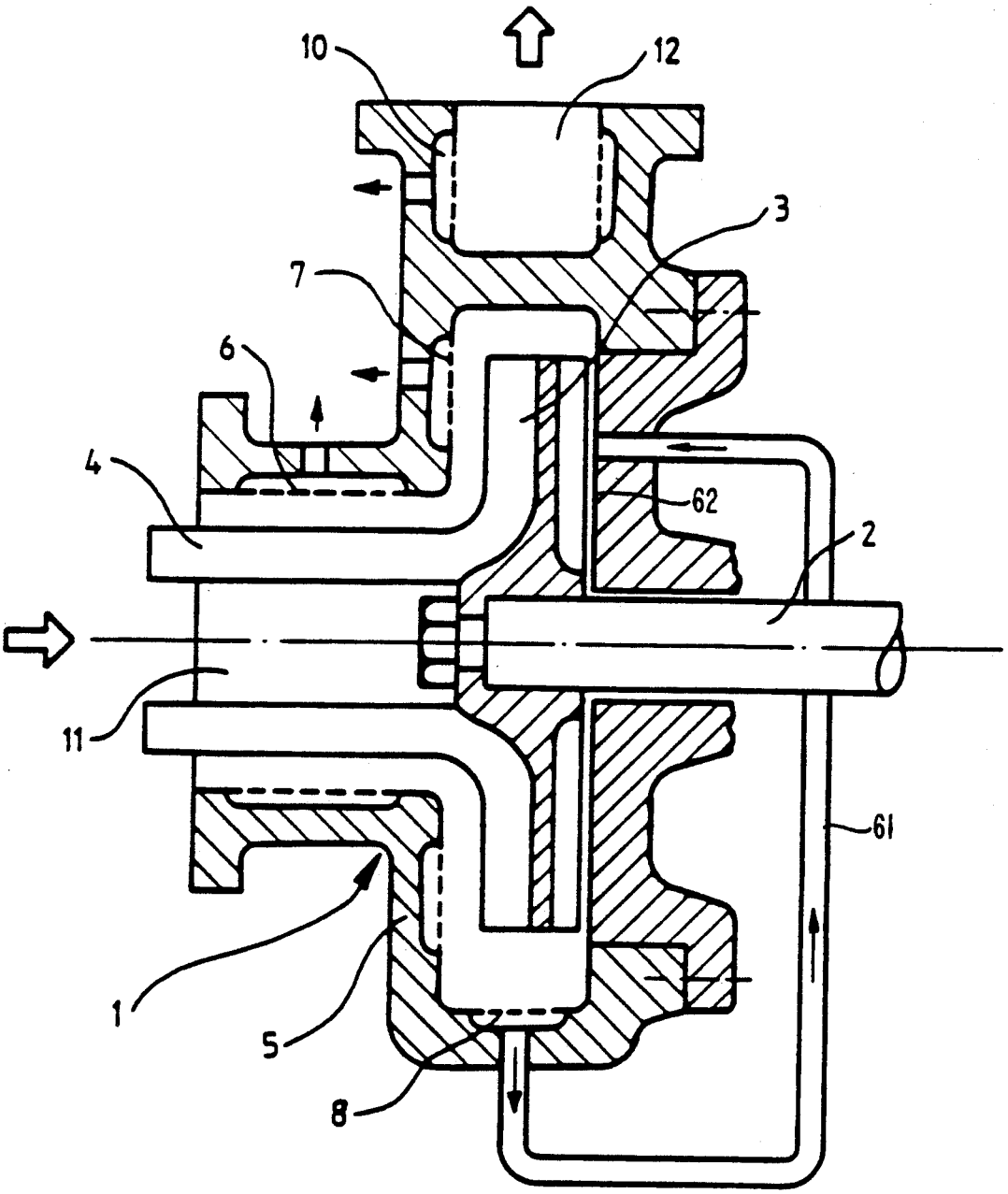
FIG. 7 shows another embodiment of the invention wherein the separated liquid is returned to the pump.
Figure 8:
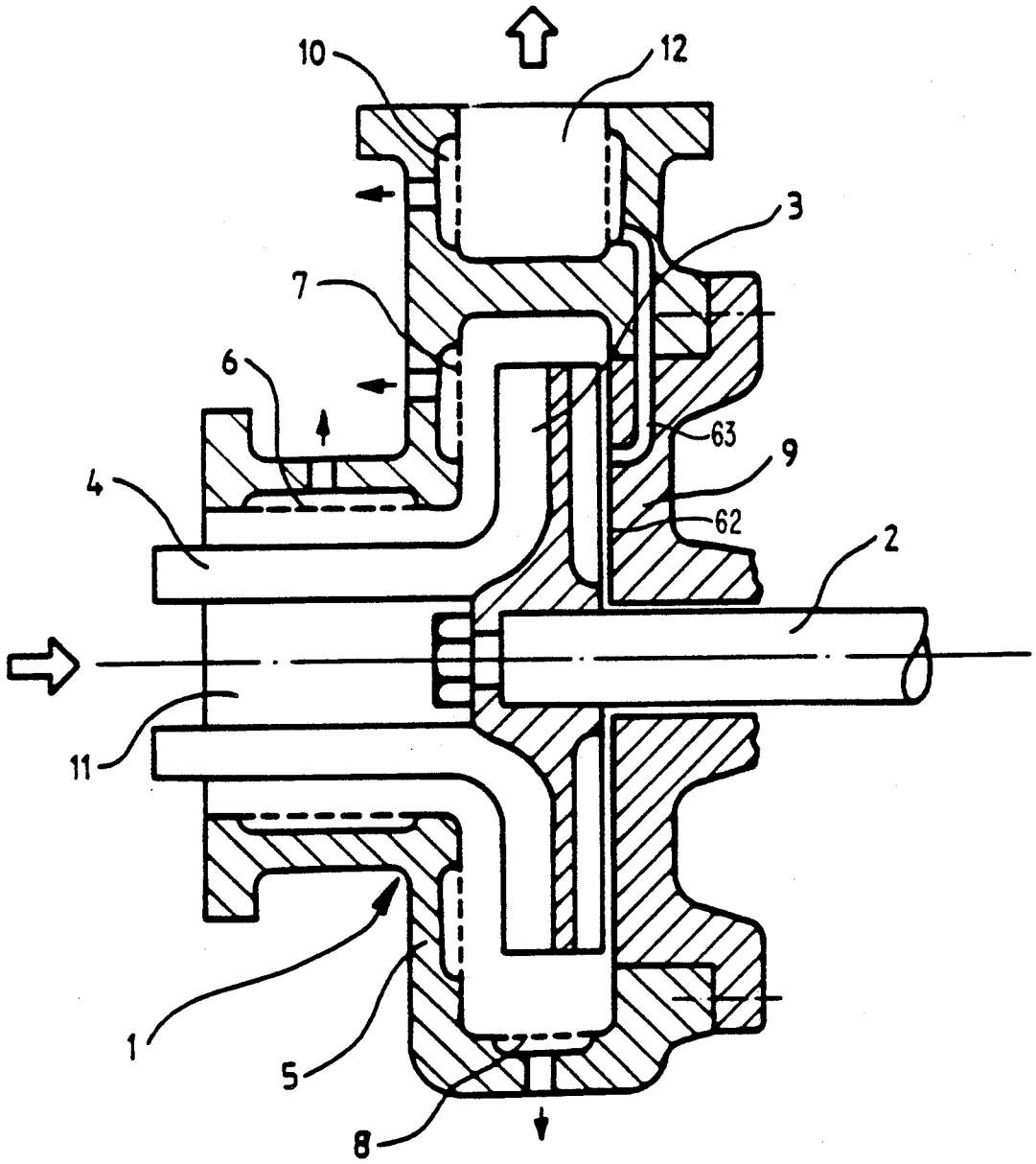
FIG. 8 shows a further embodiment of the pump shown in FIG. 7.

As shown in FIGS. 7 and 8, in some cases it is advantageous to feed dilution water to a location 62 behind the impeller of the pump. For example, in pumps containing a degasification system or device either as an integral part of the pump or as a separate unit, dilution liquid may be fed to the area 62 around the back vanes for diluting the pulp flowing between the vanes so as to increase and improve the pulp flow from behind the impeller to the main flow of pulp thereby preventing clogging the gap between the impeller and the back wall of the pump.

As shown in FIG. 7, dilution liquid is directed through filter surface or separating means 8 via external conduit 61 to area 62. Alternatively, the dilution liquid may also be directed through internal conduit 63 as is shown in FIG. 8.

Thus, according to the invention, it is possible to feed filtered liquid to problem areas within the pump system including the degasification system to dilute pulp flocks which may occasionally form inside the pump and which are harmful to the pumping process. It is also possible to feed liquid discharged from the pulp to a container for temporary storage from which the liquid may be fed back, to dilute occasional consistency peaks or pulp flocks in the pump as for example at or around area 62, or adjacent the pump, which flocks may otherwise impair the trouble-free pumping operation. It will be appreciated that it is not necessary to feed the liquid separated from one or more of the filter surfaces to only one location within the system, but it is possible to direct the liquid at the same time to many different points within the pumping process as needed.

None of the above figures show a device for withdrawing the internal dilution liquid filtered from the pulp, because no device, such as a pump, is needed if the filter surfaces are located on the discharge side in a pressurized chamber, since the liquid flows by itself due to the pressure created by the height of the pulp in the mass tower and the pressure generated by the pump. On the other hand, if the dilution liquid is taken from the filter surface on the suction side, a pump may be necessary to convey the liquid to the pulp vessel. Similarly, a pump may be necessary when feeding dilution liquid to the pressure accumulator, if such is used, since only in rare cases can the pressure accumulator be charged without a separate hydraulic pump, in other words, when liquid is discharged from the discharge side, whereby the liquid is discharged almost at the pressure developed by the pump.

It is also possible to provide a heat exchanger in the return pipe for the dilution liquid, either to recover heat from the filtered liquid or to heat the filtered liquid. Especially when the pumping unit is located in communication with a washer or the like, the outlet pulp of which is extremely hot, it is advantageous to recover the heat therefrom. In certain circumstances, it is also advantageous to heat the pulp.

As can be seen from the above description, a new type of centrifugal pump has been developed enabling the pumping of thicker pulp than heretofore possible without the risk of arching of the pulp in the proximity of the suction opening of the pump or without preventing the pulp from reaching the impeller of the pump. However, the embodiments have been described only to illustrate the invention and should thus not be construed in a limiting sense. Thus it is by no means necessary for a centrifugal pump to be used in accordance with the present invention to be a so-called fluidizing pump, but other pumps may be also utilized. Accordingly, it is quite possible to utilize the present invention with a conventional centrifugal pump or a pump in which a screw feeder is used for feeding the pulp to the pump, such as a so-called inducer or the like. Neither is it necessary for the filter surfaces filtering the dilution water to be located exactly where they are located in the shown embodiments of FIGS. 1 and 2. Similarly, the term "pumping process" is understood to include all the operations connected to the pumping of liquid-fiber suspensions, in other words starting from the moment when the suspension begins to move towards a pump until the moment when the suspension is discharged from the outlet opening of a pump. Also, the term "degasifying system" is understood to refer to known degasifying apparatus including the particular degasifying part of the pump or additional devices used in communication with a pump for degasifying the liquid-fiber suspension.

What is claimed is:

1. A method of pumping a liquid-fiber suspension with a pump having a housing with an inlet and outlet comprising the steps of:

(a) moving said suspension into said pump;

(b) separating a portion of the liquid part of said suspension from said suspension through a filter surface by the pumping action; and (c) directing said separated liquid to said suspension at a point somewhere between a situs in advance of said pump inlet and said pump outlet so as to increase the amount of the liquid in the suspension to be moved into the pump and thereby facilitating the movement of said suspension through said pump.

2. The method according to claim 1, wherein said liquid-pulp suspension has a consistency of between about 10 and about 15%.

3. The method of claim 1, wherein the consistency of said liquid-pulp suspension is above about 15%.

4. The method according to claim 1, wherein said pump comprises an impeller and back vanes and wherein said separated liquid is directed to said suspension between said back vanes and said housing.

5. The method according to claim 1, wherein said pump comprises a degasifying system and said separated liquid is directed to said separated suspension so as to prevent clogging of said degasifying system by said separated suspension.

6. The method according to claim 1, wherein said separated liquid is directed to said liquid-fiber suspension at a situs in advance of said pump inlet so that the consistency of the suspension entering the pump inlet is lower than the consistency of the suspension exiting from the pump outlet.

7. The method according to claim 1, wherein said pump is operatively connected to a vessel for said liquid-fiber suspension and wherein said separated liquid is directed to said liquid-fiber suspension in said vessel in advance of said pump inlet for reducing the friction between said liquid-fiber suspension and the vessel walls and for diluting said liquid-fiber suspension.

8. The method according to claim 7, wherein said separated liquid is directed to said liquid-fiber suspension as a pulsating flow.

9. The method according to claim 7, wherein said separated liquid is directed to said liquid-fiber suspension as a non-pulsating, continuous liquid-flow.

10. The method according to claim 1, wherein said pump comprises means for sucking said liquid-fiber suspension into said pump, said means creating a range of suction in the vicinity of said pump inlet from which said liquid-fiber suspension is being sucked into the pump; and wherein said separated liquid is directed to said liquid-fiber suspension immediately prior to reaching said range of suction.

11. The method according to claim 1, wherein said pump comprises means for sucking said liquid-fiber suspension into said pump, said means creating a range of suction in the vicinity of said pump inlet from which said liquid-fiber suspension is being sucked into the pump; and wherein said separated liquid is directed to said liquid-fiber suspension at a situs in advance of said pump inlet.

12. The method according to claim 1, wherein said separated liquid is directed to said liquid-fiber suspension within said pump housing in advance of said pump outlet.

13. The method according to claim 1, wherein said pump comprises means for sucking said liquid-fiber suspension into said pump, said means creating a range of suction in the vicinity of said pump inlet from which said liquid-fiber suspension is being sucked into the pump; and wherein said separated liquid is directed to said suspension at a situs in advance of said range of suction.

14. An apparatus for pumping a liquid-fiber suspension comprising:

a pump including a housing having an inlet and an outlet and a space defined between said inlet and outlet;

means comprising a filter surface in said pump housing space for separating and removing from said housing space a portion of the liquid part from said suspension.

15. The apparatus according to claim 14, further comprising:

a vessel for containing liquid-fiber suspension and for supplying said suspension to said housing inlet; and conduit means in communication with said separating means and said vessel for directing said separated liquid from said separating means to said vessel.

16. The apparatus according to claim 14, further comprising conduit means in communication with said separating means and said housing space for directing said separated liquid from said separation means to said space.

17. The apparatus according to claim 15, wherein said vessel is a mass tower.

18. The apparatus according to claim 15, wherein said vessel is a drop leg.

19. The apparatus according to claim 14, wherein said pumping apparatus is a centrifugal pump.

20. The apparatus according to claim 19, wherein said separating means protrudes into a supply of the liquid-fiber suspension.

21. The apparatus according to claim 20, wherein the apparatus further comprises a rotor mounted for rotation within said housing; said rotor having a portion disposed proximate said separating means for causing the separation of said liquid from the liquid-fiber suspension at said separating means.

22. The apparatus according to claim 21, wherein said rotor portion is surrounded substantially coaxially by said filter surface.

23. The apparatus according to claim 22, further comprising at least a vane on said rotor.

24. The apparatus according to claim 21, wherein said rotor portion extends beyond said separating means into said liquid-fiber suspension.

25. The apparatus according to claim 21, wherein said rotor portion includes a screw-like feeding member.

26. The apparatus according to claim 19, further comprising a vessel connected to said pump housing for containing liquid-fiber suspensions; said housing having a front wall; and said separating means forming at least part of said front wall of the pump housing so that liquid separated from the suspensions by said separating means is returned directly to the liquid-fiber suspension in said vessel.

27. The apparatus according to claim 26, wherein said vessel has a bottom; and said pumping apparatus is connected to said vessel bottom.

28. The apparatus according to claim 21, wherein said filter surface comprises a perforated surface.

29. The apparatus according to claim 27, wherein said perforations have a size of less than 0.5 mm.

* * * * *